US011970848B2

(12) United States Patent
Lin et al.

(10) Patent No.: US 11,970,848 B2
(45) Date of Patent: Apr. 30, 2024

(54) VERTICAL RAILSLIDER AND MOBILE SHOWERHEAD HOLDER

(71) Applicant: FUJIAN XIHE SANITARY WARE TECHNOLOGY CO., LTD., Fujian (CN)

(72) Inventors: Xiaofa Lin, Fujian (CN); Xiaoshan Lin, Fujian (CN); Zhiwei Chen, Fujian (CN); Feiming Deng, Fujian (CN); Xiaoqing Deng, Fujian (CN); Qiqiao Liu, Fujian (CN)

(73) Assignee: FUJIAN XIHE SANITARY WARE TECHNOLOGY CO., LTD., Fujian (CN)

( * ) Notice: Subject to any disclaimer, the term of this patent is extended or adjusted under 35 U.S.C. 154(b) by 12 days.

(21) Appl. No.: 17/844,046

(22) Filed: Jun. 19, 2022

(65) Prior Publication Data

US 2023/0049835 A1 Feb. 16, 2023

(30) Foreign Application Priority Data

Aug. 10, 2021 (CN) ..... 202110916076.9

(51) Int. Cl.
*E03C 1/06* (2006.01)

(52) U.S. Cl.
CPC ..... *E03C 1/066* (2013.01)

(58) Field of Classification Search
CPC ..... E03C 1/066
USPC ..... 4/570, 605
See application file for complete search history.

(56) References Cited

FOREIGN PATENT DOCUMENTS

CN 102824132 A * 12/2012 ..... A47K 3/281
EP 3581723 A1 * 12/2019 ..... E03C 1/066

* cited by examiner

*Primary Examiner* — Tuan N Nguyen
(74) *Attorney, Agent, or Firm* — JCIPRNET

(57) ABSTRACT

A vertical rail slider and a mobile showerhead holder are provided. The vertical rail includes a body, provided with a sleeve portion configured to be sleeved on and fitted with the vertical rail; a rotation piece, rotatably connected to the body around a rotation axis perpendicular to an axial direction of the vertical rail; an abutting piece, sliding along a direction perpendicular to the rotation axis in a radial direction of the vertical rail relative to the body and abutting against the vertical rail to be fitted with the sleeve portion to be attached to the vertical rail; and an elastic piece, wherein two ends of the elastic piece abut against the abutting piece and the body to push the abutting piece to abut against the vertical rail.

12 Claims, 9 Drawing Sheets

VERTICAL RAILSLIDER AND MOBILE SHOWERHEAD HOLDER

CROSS-REFERENCE TO RELATED APPLICATION

This application claims the priority benefit of China application no. 202110916076.9, filed on Aug. 10, 2021. The entirety of the above-mentioned patent application is hereby incorporated by reference herein and made a part of this specification.

BACKGROUND

Technical Field

The disclosure relates to the technical field of mobile showerhead holders, and in particular, relates to a vertical rail slider and a mobile showerhead holder.

Description of Related Art

In the principle of an existing mobile showerhead holder, a friction block is generally arranged on the moving base, and the friction block may be attached to or detached from the lifting rail to achieve the effect of fixing or moving. The attachment of the mobile showerhead holder of this kind is usually realized by a force exerted by a spring. When moving is required, a user presses the button in the extending direction of the spring, so that the friction block overcomes the elastic force of the spring and releases the lifting rail. When the mobile showerhead holder with this structure is used, the user's force application direction is generally lateral, that is, the user's hand action applies the force towards the left or right side. When the elastic force of the spring is large, the user needs to apply a large force, which may cause the lifting rail to deform. Further, in order to conveniently apply a force, while the thumb is pressing the button, the user needs to hold other portions of the holder with the other fingers. In addition, the position of the holder needs to be adjusted with the assistance of the other hand, which makes it difficult for the user to adjust the position of the holder when the user is holding something in his/her hand.

SUMMARY

The objective of the disclosure is to overcome the above-mentioned defects or problems in the BACKGROUND section, so the disclosure provides a vertical rail slider and a mobile showerhead holder, and according to the mobile showerhead holder through cooperation of inclined surfaces of a rotation piece and an abutting piece, when a user toggles the rotation piece, the abutting piece is moved away from a vertical rail, the holder is released from a state of being attached to the vertical rail, the force of the user to toggle the rotation piece accordingly pushes the holder up or down, and such operation is more convenient than that of an existing holder.

To accomplish the foregoing objective, the following technical solutions are adopted by the disclosure.

The disclosure provides a vertical rail slider configured to be attached to or detached from a vertical rail to be fixed to or to move relative to the vertical rail, and the vertical rail slider includes a body, a rotation piece, an abutting piece, and an elastic piece. The body is provided with a sleeve portion configured to be sleeved on and fitted with the vertical rail. The rotation piece is rotatably connected to the body around a rotation axis perpendicular to an axial direction of the vertical rail. The abutting piece slides along a direction perpendicular to the rotation axis in a radial direction of the vertical rail relative to the body and is adapted to abut against the vertical rail to be fitted with the sleeve portion to be attached to the vertical rail. Two ends of the elastic piece respectively abut against the abutting piece and the body to push the abutting piece to abut against the vertical rail. The rotation piece is configured to be adapted to be fitted with the abutting piece through fitting of the inclined surfaces to drive the abutting piece away from the vertical rail through rotation.

Further, the abutting piece is provided with an abutting portion to be fitted with the rotation piece through fitting of the inclined surfaces, and the abutting portion is provided with a first abutting surface and a second abutting surface which are arranged in the axial direction of the vertical rail and are inclined surfaces or arc surfaces.

Further, the rotation piece includes an abutting buckle, the abutting buckle is provided with an overlapping portion overlapping with the abutting portion in the radial direction of the vertical rail, and the overlapping portion obliquely abuts against the first abutting surface or the second abutting surface when the rotation piece rotates.

Further, the abutting buckle is provided with a first elastic arm and a second elastic arm. The first elastic arm and the second elastic arm respectively abut against the first abutting surface and the second abutting surface when the rotation piece is located at a first rotation position. The abutting piece is driven by the elastic piece to abut against the vertical rail when the rotation piece is located at the first rotation position.

Further, the rotation piece further includes a rotation base. The rotation base is provided with a toggle portion and a transition portion. The transition portion is rotatably connected to the body and is provided with an abutting buckle installation groove. The abutting buckle is provided with a clamping portion suitable for being inserted into and fitted with the abutting buckle installation groove. The toggle portion is adapted to receive a force to drive the rotation piece to rotate relative to the body.

Further, the body is provided with a sliding buckle extending along a direction perpendicular to the rotation axis in the radial direction of the vertical rail. The abutting piece is provided with a clamping slot, and two ends of the abutting piece in the direction of the rotation axis are provided with the abutting portion. The sliding buckle is configured to be suitable for being inserted into the clamping slot and clamped to and fitted with the abutting piece. The abutting piece is configured to be adapted to slide in an extending direction of the sliding buckle and is limited by the sliding buckle to prevent the abutting piece from being detached from the body.

Further, the abutting piece includes an abutting base and an abutting block. The abutting base is slidably connected to the body and is provided with the clamping slot. The abutting block is fixedly connected to the abutting base and is configured to be adapted to abut against the vertical rail.

Further, the body includes an inner frame, a fixed frame, and an outer casing. The inner frame is fixedly connected to the outer casing and is rotatably connected to the rotation piece. The fixed frame is fixedly connected to the inner frame and is provided with the sliding buckle. The outer casing is provided with the sleeve portion.

Further, the rotation piece is provided with two transition portions in the extending direction of the rotation axis, and the two transition portions are rotatably connected to two ends of the inner frame respectively and are located at two ends of the outer casing respectively.

The disclosure further provides a mobile showerhead holder including the vertical rail slider according to any one of the above and a showerhead bracket. The showerhead bracket is fixedly connected to the body of the vertical rail slider.

Based on the above description of the disclosure, the disclosure exhibits the following beneficial effects compared to the related art.

1. The vertical rail slider may be sleeved on the vertical rail through the sleeve portion, and the abutting piece provided thereon may be attached to the vertical rail by abutting against the vertical rail, so that the vertical rail slider may be fixed relative to the vertical rail. When the abutting piece is away from the vertical rail, the vertical rail slider may move relative to the vertical rail in the axial direction of the vertical rail. The sliding of the abutting piece relative to the body is driven by the rotation piece and the elastic piece, and the rotation piece may rotate relative to the body. When being driven by the user to rotate upwards or downwards from the initial position, the rotation piece may obliquely abuts against the abutting piece, such that the abutting piece slides away from the vertical rail from the position where it abuts against the vertical rail, and the vertical rail slider thereby is able to move. When driving the vertical rail slider to move, the user may push up or down against the rotation piece with hands, arms, and other parts. Herein, the rotation piece is offsetting by force, and its offset direction is consistent with the force direction. When the rotation piece is offsetting, the abutting piece moves away from the vertical rail, so that the vertical rail slider is able to move. Therefore, the force of the user urging against the rotation piece also becomes the force driving the entire vertical rail slider to move up and down. Therefore, the user only needs to push the rotation piece to achieve the two purposes of releasing the vertical rail slider from the vertical rail and driving the vertical rail slider to move. When the user stops pushing the rotation piece, the elastic piece may drive the abutting piece to return to the position where it abuts against the vertical rail, so that the vertical rail slider may be attached to the vertical rail again. Therefore, the vertical rail slider is more convenient to use than the existing push-type slider.

2. The abutting piece is provided with the abutting portion, and the abutting portion is provided with the abutting surfaces that are inclined surfaces or arc surfaces. The rotation piece may abut against the abutting surface through fitting of the inclined surfaces. In addition, due to the fitting of the inclined surfaces, the rotation of the rotation piece may be converted into the sliding of the abutting piece, so that the user may make the abutting piece away from the vertical rail by toggling the rotation piece.

3. The rotation piece includes the abutting buckle. The abutting buckle is fitted with the abutting portion in an overlapping manner, and the abutting buckle may obliquely abut against the abutting surface when the rotation piece rotates. Through the way of clamping connection, the position where the rotation piece is toggled by the user may be set on the front side of the vertical rail, and the position where the abutting piece abuts against the vertical rail may be set on the rear side of the vertical rail. Therefore, a regular structure is provided, and it is convenient for the user to use.

4. The abutting buckle is provided with the elastic arms. The elastic arms may abut against the abutting surfaces of the abutting piece when the rotation piece is in the first rotation position. The first rotation position is the position where the rotation piece is not being driven, and at this position, the elastic arms may be used to prevent the abutting piece from shaking, so as to ensure the stability while the abutting piece is abutting against the vertical rail.

5. The rotation piece further includes the rotation base. The rotation base is provided with the toggle portion for the user to push the rotation piece and the transition portion for connecting to the body, and the transition portion is provided with the abutting buckle installation groove. The abutting buckle is clamped and fixed to the abutting buckle installation groove through the clamping portion disposed thereon.

6. The body is provided with the sliding buckle, and the abutting piece is provided with the clamping slot. The sliding buckle may pass through the clamping slot and then be clamped to the abutting piece, and the abutting piece may slide along the sliding buckle and be limited by the sliding buckle, so that the abutting piece may not be detached from the body.

7. The abutting piece includes the abutting base and the abutting block. The abutting base is used for being fitted with the rotation piece to be driven by the rotation piece to slide relative to the body, and the abutting block is used for being fitted with the sleeve portion of the body to be attached to the vertical rail by abutting against the vertical rail.

8. The body includes the inner frame, the fixed frame, and the outer casing. The inner frame is used for being rotatably connected to the rotation piece, the fixed frame is used for being slidably fitted with the abutting piece, and the outer casing is provided with the sleeve portion.

9. The rotation piece is provided with two transition portions. After the two transition portions are rotatably connected to both ends of the inner frame, then the outer casing may be clamped to prevent the inner frame from being detached from the outer casing.

10. The mobile showerhead holder adopts the vertical rail slider, so that the mobile showerhead holder provided by the disclosure is more convenient to use than a conventional mobile showerhead holder.

BRIEF DESCRIPTION OF THE DRAWINGS

To make the technical solutions provided in the embodiments of the disclosure more clearly illustrated, several accompanying drawings required by the embodiments for description are briefly introduced as follows. Obviously, the drawings in the following description are only some embodiments of the disclosure, and for a person having ordinary skill in the art, other drawings can be obtained based on these drawings without inventive effort.

DESCRIPTION OF THE EMBODIMENTS

Figure 1:
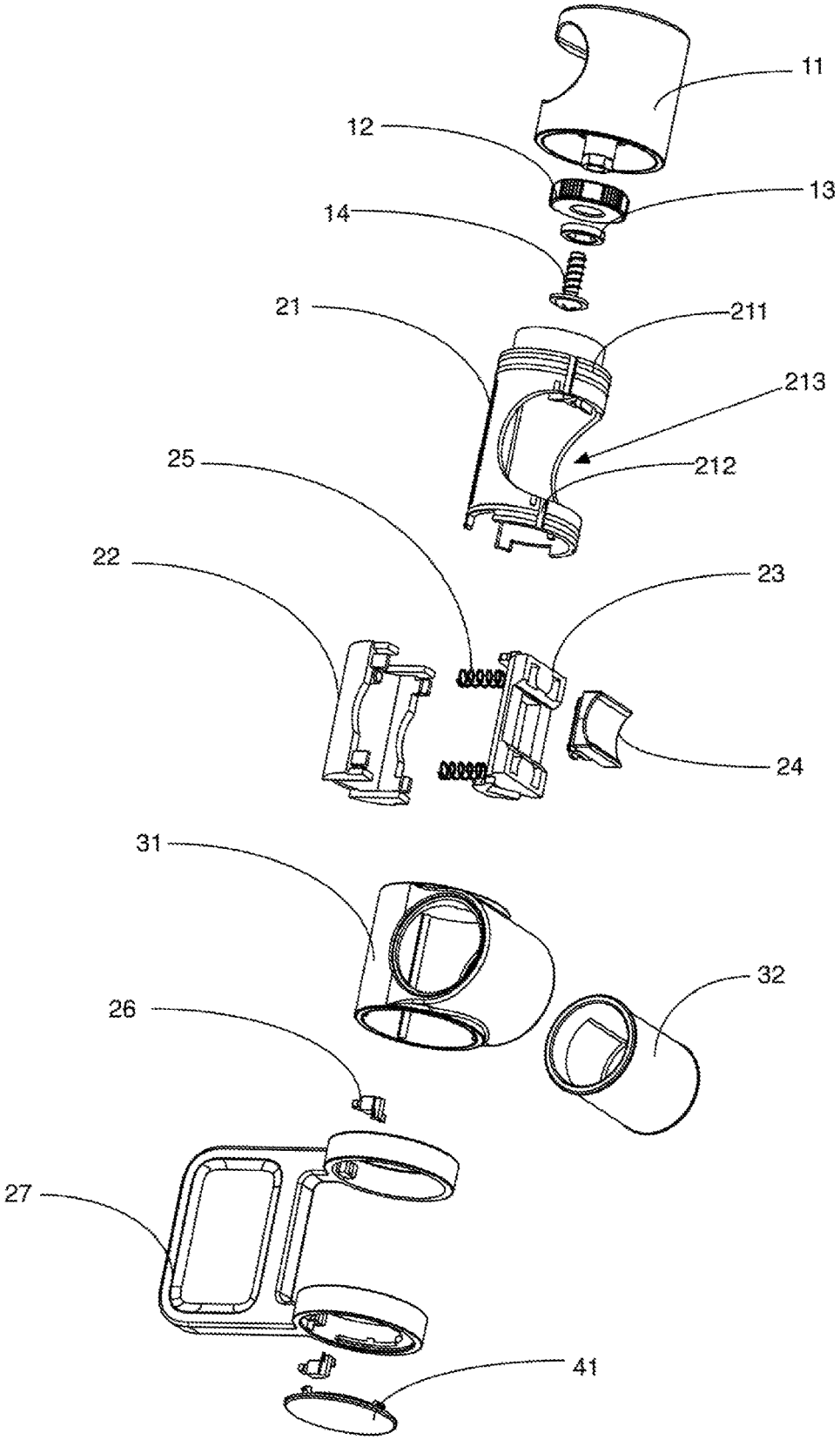
FIG. 1 is a schematic exploded view of a structure of a mobile showerhead holder according to an embodiment of the disclosure.

The accompanying drawings in the embodiments of the disclosure are included to provide a clear and complete description of the technical solutions provided in the embodiments of the disclosure. Obviously, the described embodiments are preferred embodiments of the disclosure, and should not be regarded as exclusion of other embodiments. Based on the embodiments of the disclosure, all other embodiments obtained by a person of ordinary skill in the art without making any inventive effort fall within the scope that the disclosure seeks to protect.

Unless otherwise clearly defined in the claims, specification, and the above-mentioned drawings of the disclosure, the terms "first", "second", or "third" and so on are used to distinguish different objects, not used to describe a specific order.

Unless otherwise clearly defined in the claims, specification, and the above-mentioned drawings of the disclosure, for location words, such as the use of the terms "center", "transverse", "perpendicular", "horizontal", "vertical", "top", "bottom", "inner", "outer", "upper", "lower", "front", "rear", "left", "right", "clockwise", "counterclockwise", and other indication orientations or positional relationships are based on the orientations and positional relationships shown in the drawings, are provided to facilitate the description of the disclosure and simplify the description, and are not intended to indicate or imply that the indicated device or element must have a specific orientation or be constructed and operated in a specific orientation, so cannot be understood as limiting the specific protection scope of the disclosure.

In the claims, the description and the drawings of the disclosure, unless otherwise explicitly defined, if the term "fixed connection" or "fixedly connected" is used, it should be understood in a broad sense, that is, any connection method without displacement relationship and relative rotation relationship between the two, that is, including non-removable fixed connection, removably fixed connection, connected as a whole, and fixed connection through other devices or components.

In the claims, specification, and the above-mentioned drawings of the disclosure, if the words "include", "have", and variations thereof are used, it is intended to indicate "include but not be limited to".

In the claims, specification, and the above-mentioned drawings of the disclosure, if the term "fitting of the inclined surfaces" is used, it is intended to indicate that the two objects forming the fitting of the inclined surfaces have a tendency of obliquely urging against each other. By way of fitting of the inclined surfaces, movement of one object in one direction could be converted into movement of the other object in another direction.

With reference to FIG. 1, FIG. 1 is an explosive view illustrating a structure of a mobile showerhead holder according to an embodiment of the disclosure. The mobile showerhead holder mainly includes a showerhead bracket, a body, an abutting piece, a rotation piece, and an elastic piece 25. The body, the abutting piece, the rotation piece, and the elastic piece 25 are fitted with one another to form a vertical rail slider capable of allowing the mobile showerhead holder to be fixed to or to move relative to a vertical rail fixed onto a wall through being attached to or being detached from the vertical rail.

Herein, an extending direction of the vertical rail, that is, its axial direction is defined as a first direction. In this embodiment, the vertical rail is vertically arranged, and the first direction is a vertical direction. The vertical rail also has a radial direction, which is a horizontal direction. The rotation piece rotates around a horizontally extending rotation axis, and an extending direction of the rotation axis is a second direction. The abutting piece slides along a direction perpendicular to the rotation axis in the horizontal direction, and a sliding direction of the abutting piece is a third direction.

Herein, the body includes an inner frame 21, a fixed frame 22, an outer casing 31, and a sleeve 32.

With reference to FIG. 1, the inner frame 21 may be treated as a cylindrical member extending in the second direction, one end thereof in the second direction is used for being connected to the showerhead bracket, and an opening of the other end is used for installation of the abutting piece and the elastic piece 25. An outer wall of the inner frame 21 is provided with annular clamping grooves 211 at positions close to both ends, and the annular clamping grooves 211 are used for forming a rotating connection and being fitted with the rotating member. The inner frame 21 is provided with an arc-shaped opening 213 on one side in the radial direction. The opening of the arc-shaped opening 213 faces the third direction and faces the vertical rail when the holder is installed on the vertical rail. The arc-shaped opening 213 is used for the abutting piece to protrude out of the inner frame 21. Besides, a slot is provided on the other side of the inner frame 21 opposite to the arc-shaped opening 213, and the slot extends in the second direction and is used for installation of the fixed frame 22. The outer wall of the inner frame 21 is further provided with an anti-rotation groove 212 extending in the axial direction, and the anti-rotation groove 212 may be fitted with the outer casing 31 to prevent the inner frame 21 from rotating relative to the outer casing 31 around its axial direction.

Figure 2:
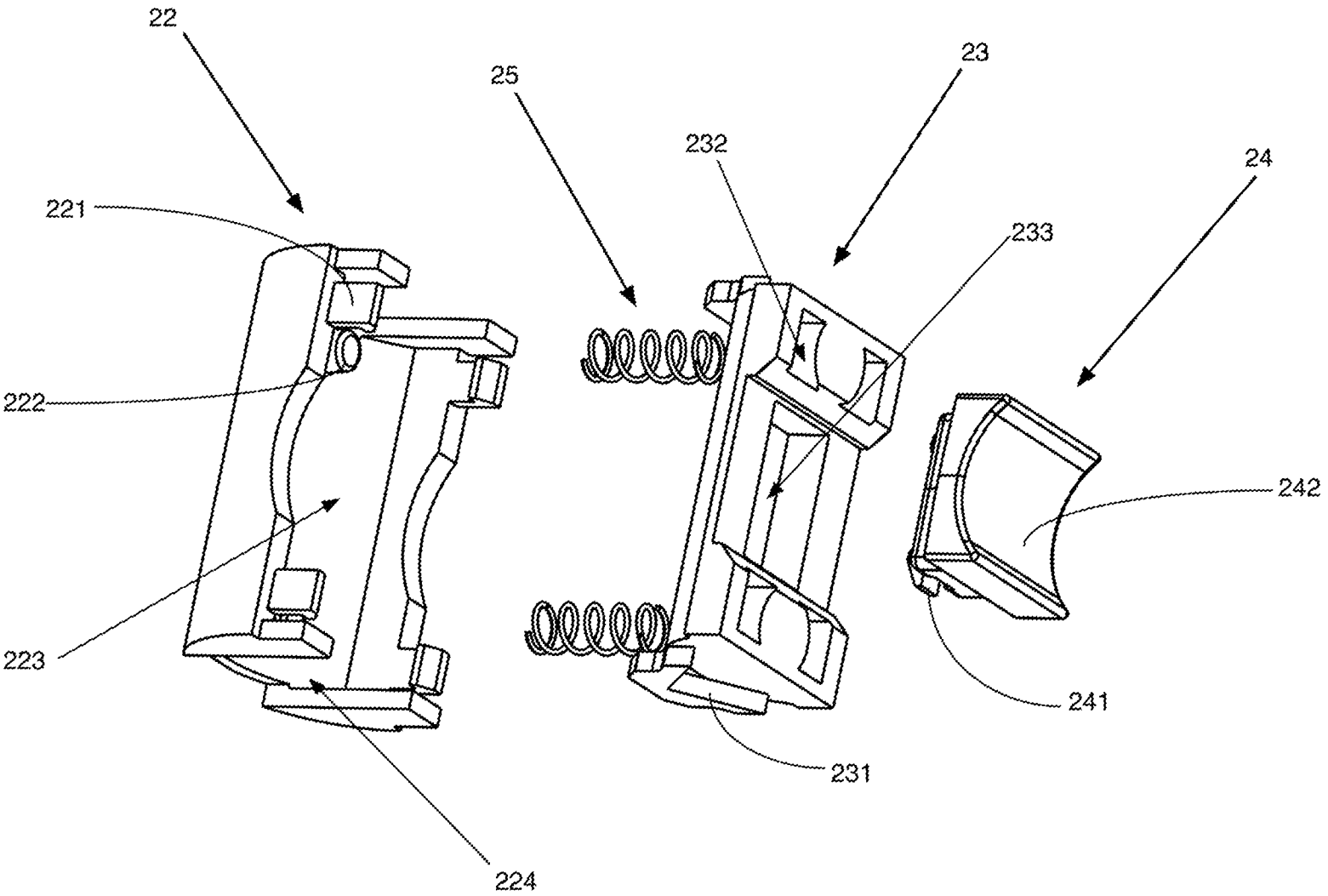
FIG. 2 is a schematic view of structures of a fixed frame, an abutting piece, and an elastic piece in FIG. 1.

With reference to FIG. 2, the fixed frame 22 is provided with a sliding groove 223 extending in the second direction, and the abutting piece is installed in the sliding groove 223 and may slide in the sliding groove 223 in the third direction. Position-limiting plates are provided at both ends of the sliding groove 223 in the second direction. Two position-limiting plates are provided at the same end position, and a position-limiting groove 224 is formed between the two position-limiting plates. The position-limiting groove 224 may be fitted with the abutting piece to limit the sliding direction of the abutting piece and prevent the abutting piece from offsetting. A plurality of sliding buckles 221 are provided on upper edges of groove walls on both sides of the sliding groove 223. The sliding buckles 221 extend in the third direction and are provided with buckle structures. An elastic piece sleeving post 222 is disposed in the sliding groove 223 near one side of the groove wall. When the elastic piece 25 is a spring, the elastic piece 25 may be sleeved on the elastic piece sleeving post 222 to prevent the elastic piece 25 from being displaced.

Figure 5:
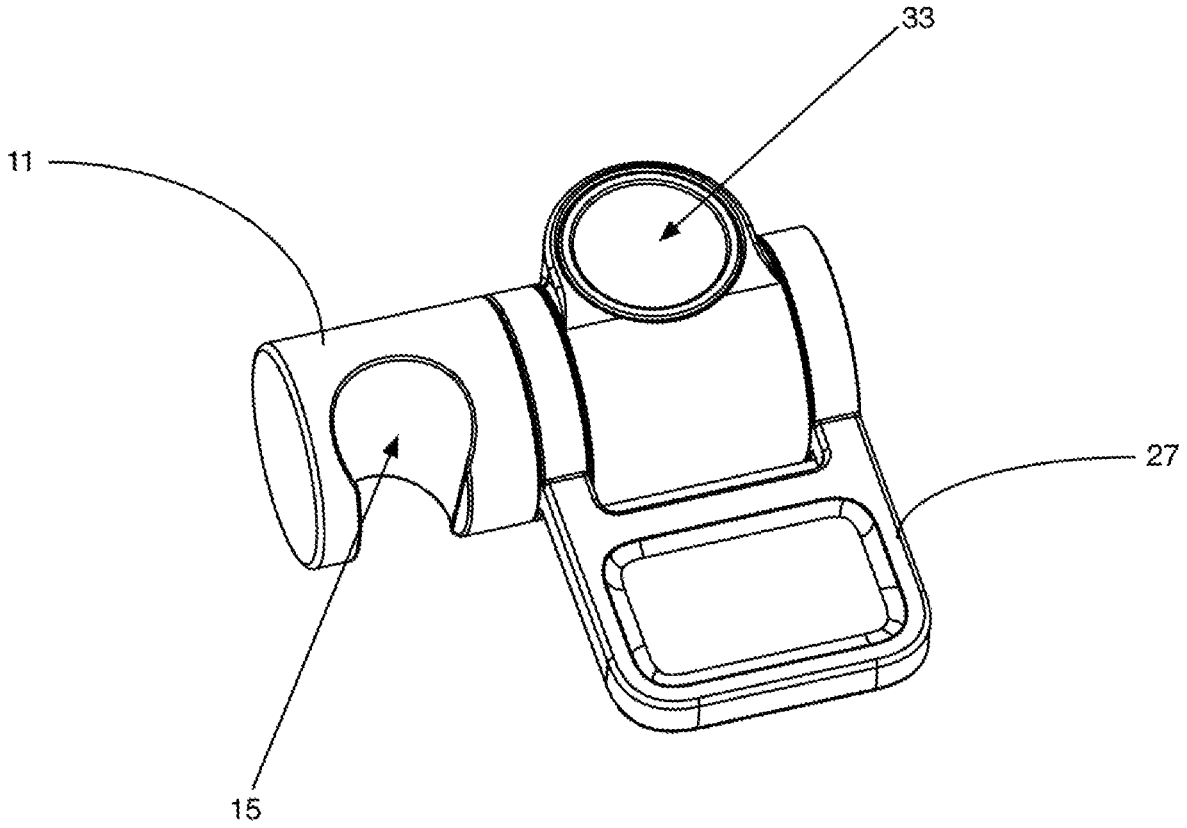
FIG. 5 is a schematic view of assembly of the mobile showerhead holder in FIG. 1.

With reference to FIG. 1 and FIG. 5, the outer casing 31 may be regarded as being formed by joining together two tubular members extending in the second direction and the first direction respectively, and joint positions of the two tubular members communicate with each other, so that inner cavities of the two tubular members fitted with each other and together form a cavity of the outer casing 31. The sleeve 32 is installed in the tubular member of the outer casing 31 extending in the first direction, and the sleeve 32 may be made of a material with a high friction coefficient such as rubber. A portion enclosed in a center of the sleeve 32 forms a sleeve portion 33, and the vertical rail may be inserted into the sleeve portion 33. It should be noted that an opening is provided in a side wall at a middle position of the sleeve 32. The opening is used for allowing the abutting piece to protrude into the sleeve portion 33, so that the abutting piece is allowed to abut against the vertical rail and be fitted with the inner wall of the sleeve portion 33 to be attached to the vertical rail, and the holder is thereby fixed onto the vertical rail.

In addition, the outer casing 31 is provided with an anti-rotation rib which is matched with the anti-rotation groove 212 of the inner frame 21, and the anti-rotation rib may be inserted into the anti-rotation groove 212 to prevent the inner frame 21 from rotating relative to the outer casing 31 in the second direction.

Figure 6:
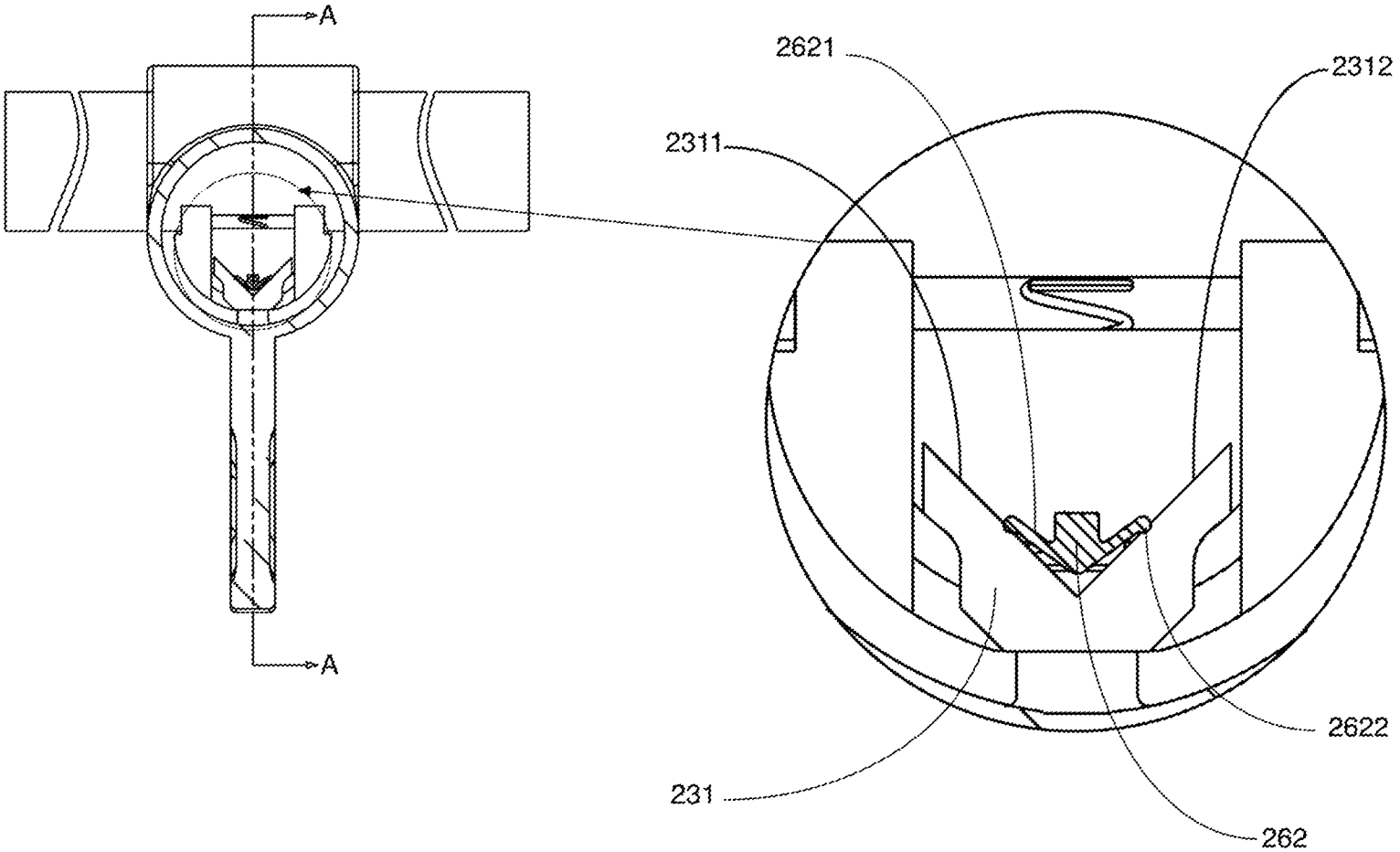
FIG. 6 is a cross-sectional enlargement view of the mobile showerhead holder in FIG. 1 in an attachment position.

With reference to FIG. 2 and FIG. 6, the abutting piece includes an abutting base 23 and an abutting block 24.

The abutting base 23 is provided with clamping slots 232 corresponding to the sliding buckles 221 on the fixed frame 22 one-to-one. The sliding buckles 221 may be inserted into the clamping slots 232 and clamped to and fitted with the abutting base 23 through the buckle structures thereon. Since each sliding buckle 221 itself has a certain length, the abutting base 23 may slide in the extending direction of the sliding buckles 221. Further, the ends of the sliding buckles 221 are clamped to the abutting base 23, the abutting base 23 may not be separated from the fixed frame 22. An abutting block mounting groove 233 is provided in the middle of the abutting base 23. The elastic piece 25 is installed between the abutting base 23 and the fixed frame 22 and is used for applying a force to the abutting base 23 to keep the abutting piece in a state of abutting against the vertical rail when no external force is applied.

With reference to FIG. 6, each of two ends of the abutting base 23 in the second direction is provided with an abutting portion 231 for being fitted with the rotation piece through fitting of the inclined surfaces. The abutting portion 231 is provided with a first abutting surface 2311 and a second abutting surface 2312 whose ends are connected to each other in the first direction. The first abutting surface 2311 and the second abutting surface 2312 are fitted with other to form a "V"-shaped structure, and the opening of this "V"-shaped structure faces the third direction. In this embodiment, the first abutting surface 2311 and the second abutting surface 2312 are inclined surfaces, but in other embodiments, the first abutting surface 2311 and the second abutting surface 2312 may be arc surfaces. In addition, the two side walls of the abutting portion 231 in the first direction may also be fitted with the position-limiting groove 224 on the fixed frame 22, so that the sliding of the abutting base 23 in the third direction is further limited.

The abutting block 24 is provided with an abutting block buckle 241, and the abutting block buckle 241 may be inserted into the abutting block mounting groove 233 on the abutting base 23 and is clamped and fixed to the abutting base 23. The abutting block 24 is provided with an abutting block frictional surface 242 facing the vertical rail. The abutting block frictional surface 242 may be made of materials such as rubber, so that a large frictional force may be formed between the abutting block frictional surface 242 and the vertical rail to ensure a sufficient attachment force to the vertical rail.

Figure 3:
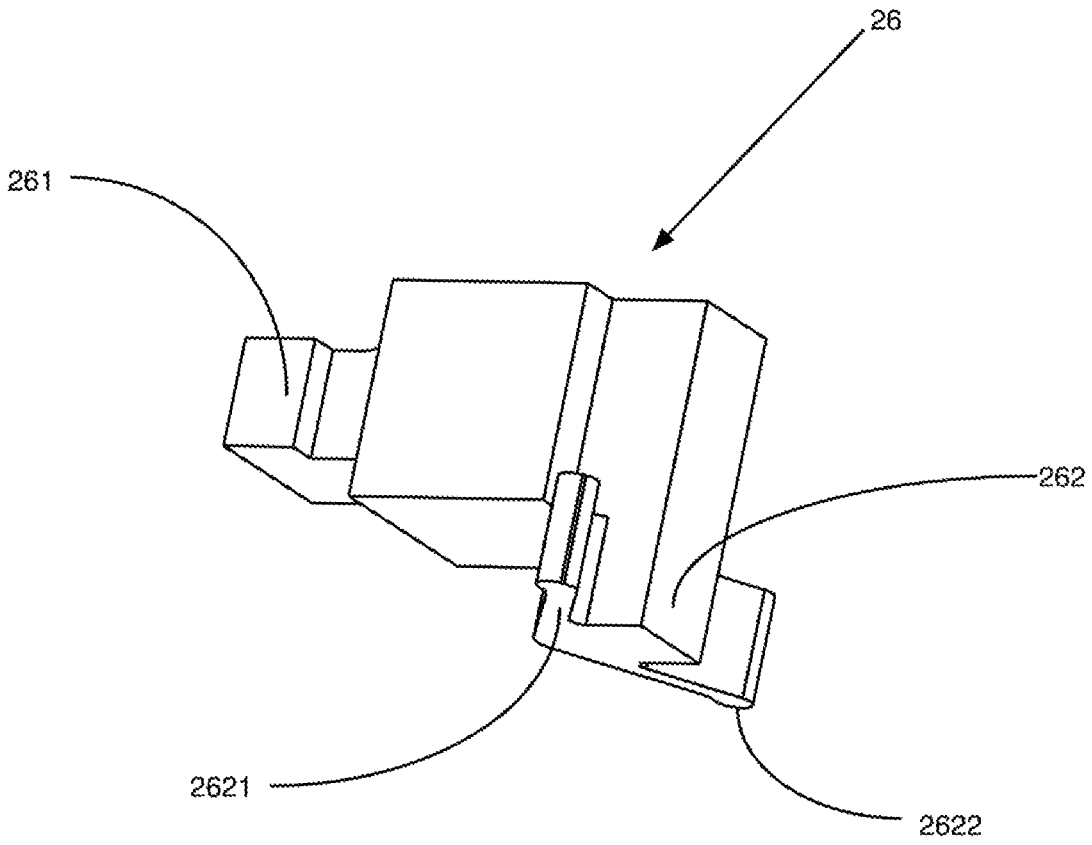
FIG. 3 is a schematic view of a structure of an abutting buckle in FIG. 1.
Figure 4:
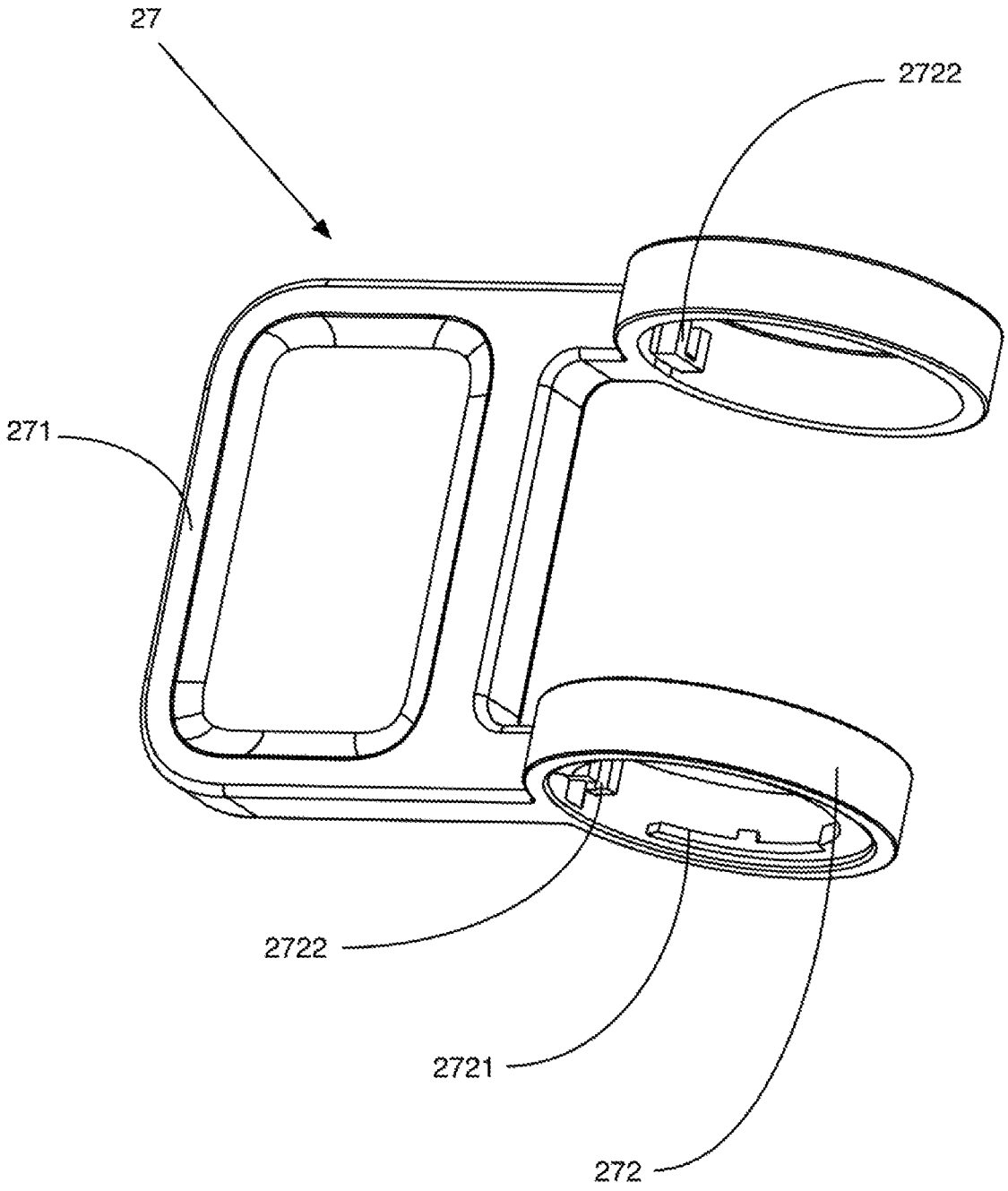
FIG. 4 is a schematic view of structure of a rotation base in FIG. 1.

With reference to FIG. 3 and FIG. 4, the rotation piece is configured to be adapted to be fitted with the abutting piece through fitting of the inclined surfaces to drive the abutting piece away from the vertical rail through rotation, and the rotation piece includes a rotation base 27 and an abutting buckle 26.

The rotation base 27 is provided with a toggle portion 271 and two transition portions 272. The transition portions 272 are disposed on one side of the toggle portion 271 and are located at two ends of the toggle portion 271 in the second direction. The toggle portion 271 is a plate-shaped member, and a user may push the toggle portion 271 by hand, so that the toggle portion 271 is inclined upwards or downwards in the first direction, thereby driving the entire rotation piece to rotate relative to the body. When the rotation piece is at a first rotation position, the toggle portion 271 is at a horizontal position. The first rotation position herein refers to the position at which the rotation piece is not being toggled. Through the arrangement of the toggle portion 271, a force bearing area of the rotation base 27 may be increased when the user uses the holder. In this way, it is convenient for the user to adjust the up and down movement of the holder through a single finger, multiple fingers, the back of the hand, or other force application points on user's body, so that the holder may be suitable for the disabled, the elderly, children, and other groups with less mobility.

The transition portion 272 is a circular ring structure, and a clamping ring 2721 extending in a circumferential direction of an inner wall of the transition portion 272 protrudes from the inner wall. The clamping ring 2721 may be fitted with the annular clamping groove 211 on the outer wall of the inner frame 21, so that the rotation base 27 may be rotatably connected onto the inner frame 21, and that the rotation piece may rotate relative to the body. The inner wall of the transition portion 272 is further provided with an abutting buckle installation groove 2722. With reference to FIG. 4, the abutting buckle installation groove 2722 is a groove-like structure with a "T"-shaped cross section, which may be clamped to, fitted with, and fixed to the abutting buckle 26.

Figure 7:
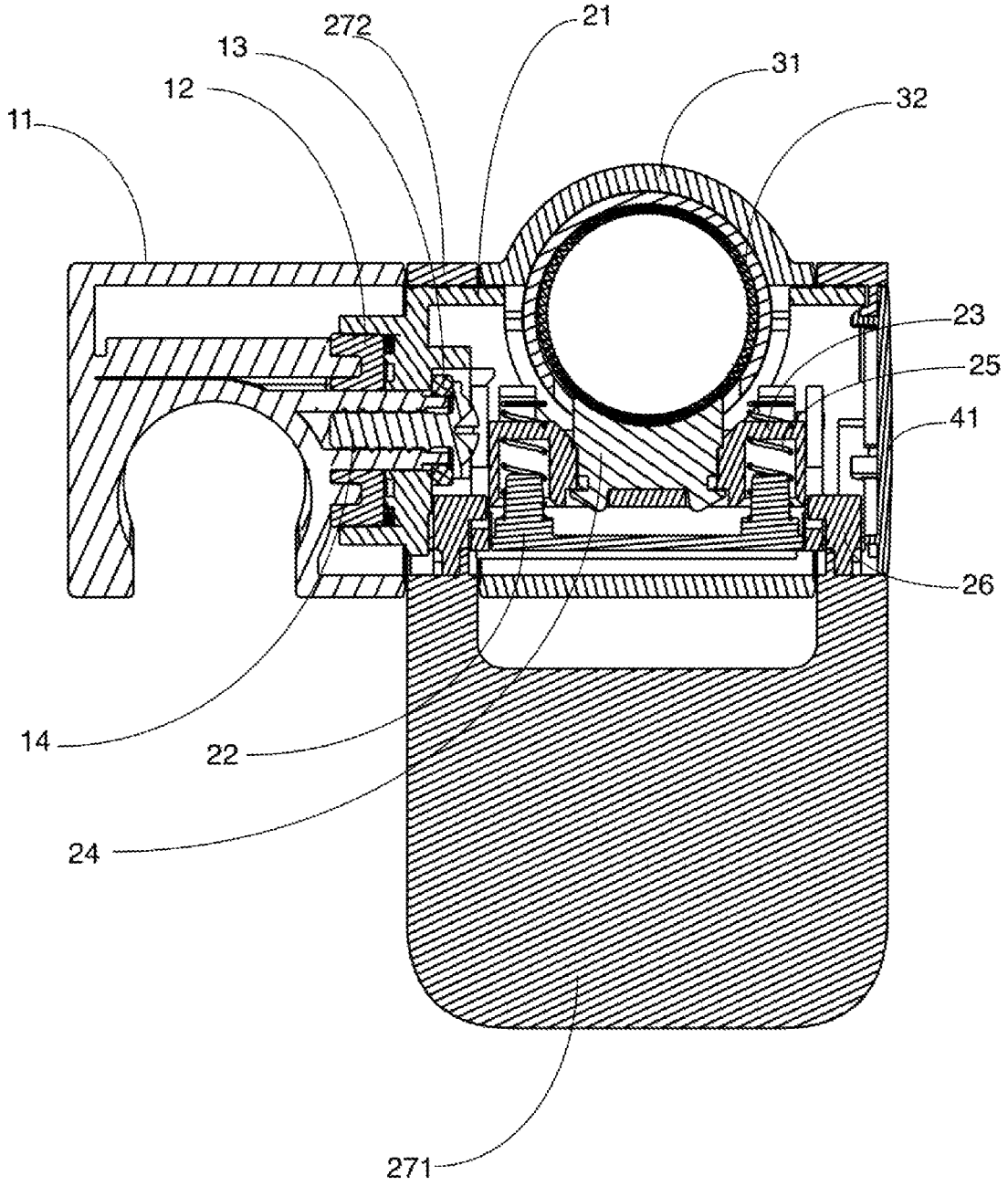
FIG. 7 is a schematic cross-sectional view taken along a cross section A-A in FIG. 6.
Figure 8:
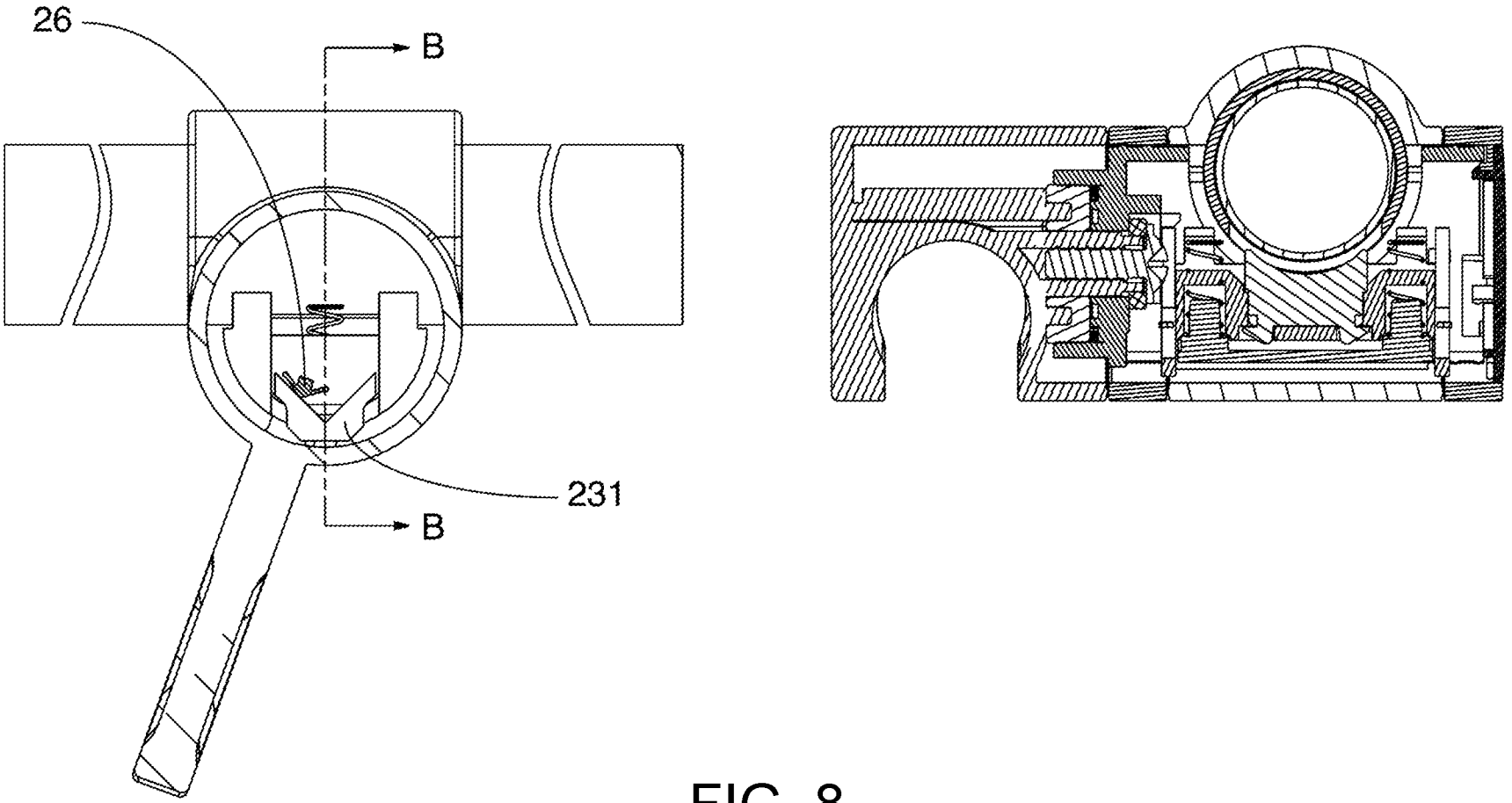
FIG. 8 is a schematic view of the structure of the mobile showerhead holder in FIG. 1 in a detachment position.

Referring to FIG. 3, one end of the abutting buckle 26 is provided with a clamping portion 261. The cross section of the clamping portion 261 forms a "T"-shaped structure, so that the clamping portion 261 may be inserted into the abutting buckle installation groove 2722 from the side, and that the abutting buckle 26 and the rotation base 27 are clamped and fixed. An overlapping portion 262 protruding towards the second direction is provided at the other end of the abutting buckle 26. The overlapping portion 262 is provided with a tip end whose tip is facing the clamping portion 261, and two sides of the tip end extend outwards to form a first elastic arm 2621 and a second elastic arm 2622. With reference to FIG. 6 and FIG. 7, the overlapping portion 262 may be fitted with the abutting portion 231 of the abutting base 23 in an overlapping manner, and an overlapping direction of the overlapping portion 262 faces the position where the toggle portion 271 is located. Further, with reference to FIG. 8, the cross-sectional view on the right side in FIG. 8 is a schematic view of a cross section B-B on the left side. When the rotation piece rotates upwards or downwards from the first rotation position, the rotation base 27 drives the abutting buckle 26 to rotate relative to the body and makes the tip end of the overlapping portion 262 abut against the first abutting surface 2311 or the second abutting surface 2312. In this way, the abutting piece is driven to against an elastic force of the elastic piece 25 and slide towards the position where the fixed frame 22 is located, so that the holder is released from the state of being attached to the vertical rail.

It should be noted that, with reference to FIG. 6, when the rotation piece is in the first rotation position, the tip end of the overlapping portion 262 is just between the first abutting surface 2311 and the second abutting surface 2312. Herein, the first elastic arm 2621 and the second elastic arm 2622 respectively abut against the first abutting surface 2311 and the second abutting surface 2312. The abutting piece may be in a relatively stable state through the first elastic arm 2621 and the second elastic arm 2622, and the abutting piece thus is prevented from shaking. In addition, protrusions are provided at the ends of the first elastic arm 2621 and the second elastic arm 2622, and the protrusions may increase the degree of deformation of the first elastic arm 2621 and the second elastic arm 2622, so that the force exerted on the abutting piece is increased, and stability of the abutting piece is further improved.

Besides, the showerhead bracket includes a showerhead base 11, a friction pad 12, a washer 13, and a screw 14.

The showerhead base 11 is provided with a showerhead inserting portion 15, and a showerhead may be inserted into the showerhead inserting portion 15 to be fixed. The showerhead base 11 is fixed onto the inner frame 21 by the screw 14, so as to form a fixed connection with the body of the holder. With reference to FIG. 7, the friction pad 12 is installed between the showerhead base 11 and the inner frame 21, and the washer 13 is installed between the screw 14 and the inner frame 21.

During installation, the showerhead base 11 is installed onto the inner frame 21 first. Next, one abutting buckle 26 is installed on the abutting buckle installation groove 2722 on the side of the rotating base 27 close to the showerhead base 11, and after the rotation base 27 is sleeved on the outer casing 31, the inner frame 21 and the showerhead base 11 are then inserted into the outer casing 31 from the end of the rotation base 27 away from the showerhead base 11. After that, the abutting piece, the elastic piece 25, and the fixed frame 22 are assembled and are inserted into the outer casing 31, and the abutting base 23 on the abutting piece is aligned with the arc-shaped opening 213 on the inner frame 21. Next, another abutting buckle 26 is installed on the abutting buckle installation groove 2722 on the other side of the rotation base 27, and a decorative cover 41 is then clamped to the transition portion 272 of the rotation base 27. Finally, the sleeve 32 is installed on the outer casing 31.

Figure 9:
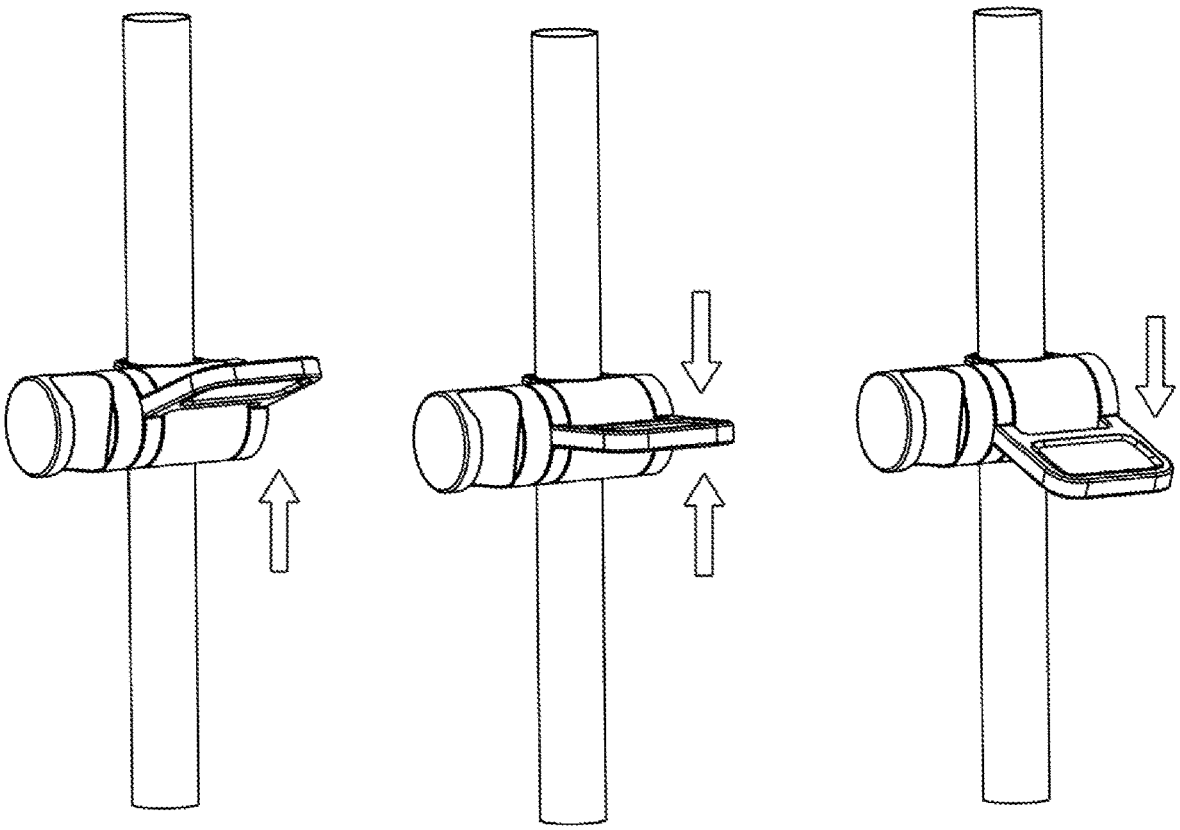
FIG. 9 is a schematic view of the mobile showerhead holder in FIG. 1 in different states after the mobile showerhead holder is assembled to a vertical rail.

In use, with reference to FIG. 9, the illustration in the middle position is a schematic view of the rotation piece in the first rotation position. When the rotation piece is in the first rotation position, the holder is attached to the vertical rail to be fixed onto the vertical rail. The holder may move upwards when the user toggles the rotation piece upwards, and the holder may move downwards when the user toggles the rotation piece downwards.

The disclosure provides the vertical rail slider and the mobile showerhead holder. In the mobile showerhead holder, as the inclined surfaces of the rotation piece and the abutting piece are fitted with each other, when the user toggles the rotation piece, the abutting piece may be moved away from the vertical rail, so that the holder is released from the state of being attached to the vertical rail. The force of the user to toggle the rotation piece may accordingly push the holder up or down, and such operation is more convenient than that of an existing holder.

Although the description of the specification and embodiments provided above serve to explain the scope of the disclosure, such description should not be construed as limitations on the scope of the disclosure. Through inspiration provided by the disclosure or the embodiments, modifications, equivalents, or other improvements of the embodiments or part of the technical features of the disclosure obtained by a person having ordinary skill in the art by combining general knowledge and common technical knowledge in the art and/or related art through logical analyses, reasoning, or limited tests fall within the protection scope of the disclosure.

What is claimed is:

1. A vertical rail slider, configured to be attached to or detached from a vertical rail to be fixed to or to move relative to the vertical rail, the vertical rail slider comprising:

a body, provided with a sleeve portion configured to be sleeved on and fitted with the vertical rail;

a rotation piece, rotatably connected to the body around a rotation axis perpendicular to an axial direction of the vertical rail;

an abutting piece, sliding along a direction perpendicular to the rotation axis in a radial direction of the vertical rail relative to the body and adapted to abut against the vertical rail to be fitted with the sleeve portion to be attached to the vertical rail, wherein the abutting piece is provided with an abutting portion having a first abutting surface and a second abutting surface; and an elastic piece, wherein two ends of the elastic piece respectively abut against the abutting piece and the body to push the abutting piece to abut against the vertical rail, wherein the rotation piece comprises an abutting buckle fitted with the abutting portion to drive the abutting piece away from the vertical rail through rotation, the abutting buckle is provided with a first elastic arm and a second elastic arm, the first elastic arm and the second elastic arm respectively abut against the first abutting surface and the second abutting surface when the rotation piece is located at a first rotation position, and the abutting piece is driven by the elastic piece to abut against the vertical rail when the rotation piece is located at the first rotation position.

2. The vertical rail slider according to claim 1, wherein the rotation piece further comprises a rotation base, the rotation base is provided with a toggle portion and a transition portion, the transition portion is rotatably connected to the body and is provided with an abutting buckle installation groove, the abutting buckle is provided with a clamping portion suitable for being inserted into and fitted with the abutting buckle installation groove, and the toggle portion is adapted to receive a force to drive the rotation piece to rotate relative to the body.

3. The vertical rail slider according to claim 2, wherein the body is provided with a sliding buckle extending along the direction perpendicular to the rotation axis in the radial direction of the vertical rail, the abutting piece is provided with a clamping slot, the sliding buckle is configured to be suitable for being inserted into the clamping slot and clamped to and fitted with the abutting piece, and the abutting piece is configured to be adapted to slide in an extending direction of the sliding buckle and is limited by the sliding buckle to prevent the abutting piece from being detached from the body.

4. A mobile showerhead holder, comprising the vertical rail slider according to claim 3 and a showerhead bracket, wherein the showerhead bracket is fixedly connected to the body of the vertical rail slider.

5. The vertical rail slider according to claim 3, wherein the abutting piece comprises an abutting base and an abutting block, the abutting base is slidably connected to the body, is provided with the clamping slot, and two ends of the abutting base in a direction of the rotation axis are provided with the abutting portion, and the abutting block is fixedly connected to the abutting base and is configured to be adapted to abut against the vertical rail.

6. A mobile showerhead holder, comprising the vertical rail slider according to claim 5 and a showerhead bracket, wherein the showerhead bracket is fixedly connected to the body of the vertical rail slider.

7. The vertical rail slider according to claim 5, wherein the body comprises an inner frame, a fixed frame, and an outer casing, the inner frame is fixedly connected to the outer casing and is rotatably connected to the rotation piece, the fixed frame is fixedly connected to the inner frame and is provided with the sliding buckle, and the outer casing is provided with the sleeve portion.

8. A mobile showerhead holder, comprising the vertical rail slider according to claim 7 and a showerhead bracket, wherein the showerhead bracket is fixedly connected to the body of the vertical rail slider.

9. The vertical rail slider according to claim 7, wherein the rotation piece is provided with two transition portions in the extending direction of the rotation axis, and the two transition portions are rotatably connected to two ends of the inner frame respectively and are located at two ends of the outer casing respectively.

10. A mobile showerhead holder, comprising the vertical rail slider according to claim 9 and a showerhead bracket, wherein the showerhead bracket is fixedly connected to the body of the vertical rail slider.

11. A mobile showerhead holder, comprising the vertical rail slider according to claim 2 and a showerhead bracket, wherein the showerhead bracket is fixedly connected to the body of the vertical rail slider.

12. A mobile showerhead holder, comprising the vertical rail slider according to claim 1 and a showerhead bracket, wherein the showerhead bracket is fixedly connected to the body of the vertical rail slider.

* * * * *